US005087011A

United States Patent [19]

Turner et al.

[11] Patent Number: 5,087,011

[45] Date of Patent: Feb. 11, 1992

[54] DETACHABLE LOCKDOWN DEVICE FOR ARENA CHAIR

[75] Inventors: Thomas J. Turner, 1602 Ruxton Crt., Ruxton, Md. 21204; David Ankers, New Freedom, Pa.

[73] Assignee: Thomas J. Turner, Ruxton, Md.

[21] Appl. No.: 659,634

[22] Filed: Feb. 20, 1991

[51] Int. Cl.[5] ..... A47B 97/00

[52] U.S. Cl. ..... 248/501

[58] Field of Search ..... 248/500, 501, 502, 503, 248/503.1, 544

[56] References Cited

U.S. PATENT DOCUMENTS

| | | | |
|---|---|---|---|
| 901,561 | 10/1908 | Searing | 248/501 |
| 910,679 | 1/1909 | Heintz | 248/503.1 |
| 2,751,969 | 4/1954 | Kruijt . | |
| 3,889,963 | 6/1975 | Brattgard . | |
| 4,052,087 | 11/1977 | Gagliardi . | |
| 4,113,307 | 8/1978 | Day . | |
| 4,229,039 | 11/1980 | Day . | |
| 4,619,452 | 10/1986 | Euteneuer et al. | 271/305 |
| 4,645,166 | 2/1987 | Checkley et al. | 248/503.1 |
| 4,781,413 | 8/1987 | Shumack . | |
| 4,874,203 | 11/1989 | Henley . | |
| 4,978,097 | 12/1990 | Frowtzis | 248/503.1 |

OTHER PUBLICATIONS

"PVA Develops Seating Design", *Paraplegia News*, Dec. 1990, p. 36.

*Primary Examiner*—Ramon O. Ramirez

*Attorney, Agent, or Firm*—Sterne, Kessler, Goldstein & Fox

[57] ABSTRACT

An apparatus for removably mounting a chair assembly to a rigid support surface such as an arena floor. The apparatus essentially comprises a base, a plurality of seat support members, a plurality of alignment members, removable securing means and unlocking means. The seat support members are attached to and extend upward from the base. The top parts of the seat support members attach to a seat member. The alignment members extend downward from opposite sides of the base and fit into openings in a rigid support surface, such as the floor of an arena. They ensure that the chair is properly aligned when installed. The removable securing means fits through an opening in the center of the base. Placing the removable securing means through an opening in the base and engaging it into an opening in the floor secures the detachable arena chair to the rigid support surface. The removable securing means is designed to be only engaged and disengaged with the unlocking means.

9 Claims, 5 Drawing Sheets

DETACHABLE LOCKDOWN DEVICE FOR ARENA CHAIR

BACKGROUND OF THE INVENTION

1. Field of the Invention

The present invention relates generally to arena seating. More particularly, the present invention is directed to an apparatus which facilitates handicapped seating in arenas.

2. Related Art

Operators of arenas (theaters, stadiums and other structures for public entertainment) generally provide seating for the handicapped (persons confined to wheelchairs). They do so to increase profits (by enabling the handicapped to patronize the arenas), to comply with ordinances requiring handicapped seating and for humanitarian reasons. There are a variety of conventional approaches to arena seating which facilitate or could facilitate the handicapped. However none adequately meets the needs of arena operators, handicapped patrons and non-handicapped patrons.

In one conventional approach, the handicapped situate their wheelchairs adjacent to seats at the ends of the aisles. This approach is generally undesirable because it interferes with the egress of other patrons and could violate fire codes.

In a second conventional approach, the handicapped sit in front of the first row or behind the last row in an arena. In these locations they are less likely to interfere with the egress of other patrons or violate fire codes. But this arrangement has several other disadvantages. It generally provides the handicapped with a poor vantage point of the event.

Also, if the handicapped are accompanied by guests, the parties can only sit together if the guests sit in the front or rear row. This may require substantial prearrangement, thus limiting the ability of the handicapped to spontaneously decide to patronize an arena. Even if the guests secure front or rear seats, sitting one-behind-the-other impairs communication between the parties. Accordingly, it limits their enjoyment of arena events and limits the ability of a parent to control his or her child when either is handicapped.

In a third conventional approach, the handicapped sit on platforms without attached seats. Portable chairs are generally provided for the handicapped guests. This arrangement has several disadvantages to arena operators.

First, it is expensive to install in an arena not originally constructed with a platform. Doing so requires the removal of seats installed to be permanent. There is generally no further use for the potentially expensive chairs removed. Portable chairs must then be purchased.

Additionally, platforms could cost decrease arena revenues. If the handicapped and their guests do not fill the platform space in a particular event, other patrons would not pay full price to sit in the portable chairs. Alternatively, if the handicapped and their parties seeking to attend an event could not fit on the platforms, they would be unwilling to attend.

The platform approach is unattractive to patrons as well. The portable chairs for the handicapped guests are often less comfortable and aesthetically pleasing than the rest of the seats in the arena. Also, because the chairs on platforms are not generally attached to anything, the chairs could be moved so as to interfere with egress. And worse, unruly patrons could use unattached chairs as projectiles.

A device described in U.S. Pat. No. 2,751,969 addresses the latter two disadvantages of portable chairs. The device locks adjacent portable seats together in such a way that only an authorized person can detach them. However the device has many small moving parts and would thus likely be expensive to purchase and maintain. Simpler devices exist to attach adjacent seats, but these are not lockable and thus would not prevent patrons from intentionally moving or throwing them. Both types of devices would only keep portable seats in place if enough such chairs were adjacent to each other to prevent a whole group from being moved. This would not necessarily be the case on a handicapped platform.

In a fourth conventional approach, the handicapped are placed in wheelchair-type devices which fit atop conventional arena seats. These devices create a variety of problems because they are designed for short-term use. The two described in U.S. Pat. Nos. 4,113,307 and 4,229,039, for example, have no back wheels and thus must be maneuvered by someone other than the handicapped. The one described in U.S. Pat. No. 3,889,963 has small wheels on folding rear legs. However this device similarly would not be practical for everyday use. Its small back wheels would not be well suited for curbs, sidewalk cracks and other rough terrain. Also, it is primarily designed to be maneuvered by someone other than the handicapped.

Because these devices would not be the handicapped persons' permanent means of transportation, the handicapped would have to be transferred to the devices. Transferring creates potential problems for both arena operators and the handicapped. For many handicapped, transferring is difficult. Depending upon the disability, it can be painful, intrusive, inconvenient or dangerous to the handicapped. For example, they could have fragile bones, sensitive body parts, body parts which need to be kept elevated, or colostomy bags or oxygen tanks that must remain with them.

Another disadvantage of these devices is that maneuvering one down a narrow row and into a seat could require tipping it to steep angles. This could be uncomfortable or dangerous to the handicapped and difficult for those attempting to seat them.

A further disadvantage of these devices is that while at the arena, the handicapped are fully dependent on others. They cannot get refreshments, use the restroom or leave the arena without assistance.

Finally, because these devices fit into arena seats, they are necessarily narrower than such seats. They would thus be uncomfortable for larger handicapped persons.

This approach has further disadvantages to arena operators. They would have to have enough of the devices to accommodate all their handicapped patrons. The devices are intricate and are made up of many moving parts and thus would likely be expensive to manufacture and maintain. Also, if stadium employees were responsible for transferring the handicapped to and from the devices, arena operators would have to provide a staff of persons with sufficient strength and skill to do so. Furthermore, arena operators would be potentially liable for injuries caused while transferring, to both employees transferring and handicapped being transferred.

In a fifth conventional approach, arena chairs are folded completely into the floor to provide space for handicapped patrons. Such chairs require space below the floor and are thus generally expensive or impractical to install. Arena operators implementing this approach would be restricted in their selection of seats. They could use only seats which could fold compactly.

Also, this approach could cause problems for the handicapped. Wheelchair tires could get caught or punctured by the gaps around the lids covering folded chairs.

Conventional arena seating enables the handicapped to patronize arenas. However, some approaches accomplish this at the expense of substantially reducing the ability of the handicapped or other patrons to enjoy the event. Others substantially reduce arena profitability. There is a need for arena seating which minimally impacts on the ability of the handicapped and other patrons to enjoy arena events and which are not unduly expensive to implement.

The present invention is a detachable lockdown device for an arena chair which can be incorporated into an arena seating arrangement so as to overcome the problems of conventional handicapped seating in arenas.

SUMMARY OF THE INVENTION

The invention is an apparatus for removably mounting a chair assembly to a rigid support surface. The invention essentially comprises a base, a plurality of seat support members, a plurality of alignment members, removable securing means and unlocking means.

The seat support members are attached to and extend upward from the base. The top parts of these members attach to a seat member.

The alignment members extend downward from opposite sides of the base. These members fit into openings in a rigid support surface. They ensure that the chair is properly aligned when installed.

The rigid support surface would commonly be an arena floor. It could also be the vertical face of a step behind the chair assembly in an arena where each row is a step higher than the one in front of it.

The removable securing means fits through an opening in the center of the base. Placing the removable securing means through an opening in the base and engaging it into an opening in the rigid support surface secures the detachable lockdown device to the rigid support surface. The removable securing means is designed to be only engaged and disengaged with the unlocking means.

FEATURES AND ADVANTAGES

The detachable lockdown device (and thus chairs attached to it) can be quickly and easily detached with a key but is immoveable without a key. Because minimal effort is required to remove the chairs, the detachable lockdown device enables the handicapped to patronize arenas without pre-arrangement. They need only have arena officials remove chairs for them upon arrival at an arena.

Handicapped patrons could remain in their wheelchairs when patronizing arenas equipped with the detachable lockdown device, thus eliminating the intrusion, dependence, inconvenience pain and risk of injury associated with transferring.

Furthermore, in an arena equipped with the detachable lockdown devices, handicapped patrons could sit anywhere a detachable lockdown device was installed. They would thus not be restricted to locations with poor vantage points. Also, they could sit adjacent to their guests and converse easily with them.

The detachable lockdown device eliminates the need for the portable chairs often provided in handicapped seating areas. It thus enables guests of the handicapped to sit in comfortable, permanent chairs. Also, because only arena officials can remove the detachable lockdown devices, chairs attached to them could not be moved so as to interfere with egress or be used as projectiles.

The detachable lockdown devices could be constructed to a broad range of specifications to accommodate nearly any seat width, height or spacing. The devices could thus be installed in a new arena without dictating the seat type or layout. Similarly, they could be installed in an existing arena without requiring the replacement of seats. Also, seats in the disabled areas could match those in the rest of the arena. The devices therefore facilitate inexpensive construction of disabled seating areas with minimal aesthetic impact.

The detachable lockdown device would be inexpensive to manufacture and install. It comprises a simple assembly of metal plates and some basic hardware and has few moving parts. It attaches to a seat with minimal welding or several bolts. It is installed by drilling three holes in a rigid support surface and tightening one bolt. Once installed, it requires minimal maintenance and has a long life.

BRIEF DESCRIPTION OF THE DRAWINGS

The foregoing features of the present invention should become apparent from the following description when taken in conjunction with the accompanying drawings, in which.

DETAILED DESCRIPTION OF THE PREFERRED EMBODIMENT

Figure 1:
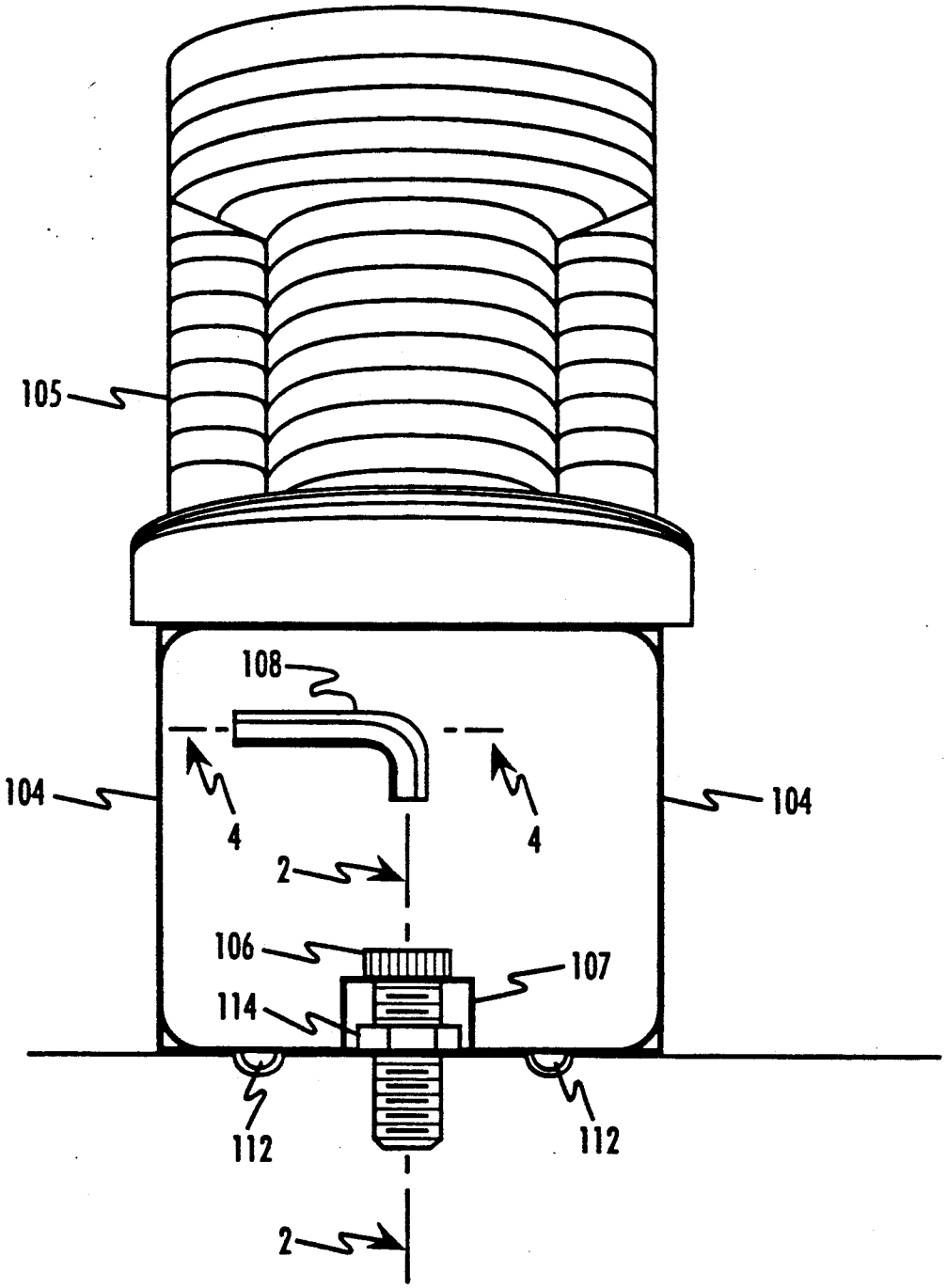
FIG. 1 is a frontal view of the device attached to a rigid support surface.

Referring first to FIG. 1, an embodiment of the detachable arena seat is shown. The invention essentially comprises a base member 101, a plurality of seat support members 104, a seat member 105, a plurality of alignment members 112, a removable securing means 106 and an unlocking means 108.

Figure 8:
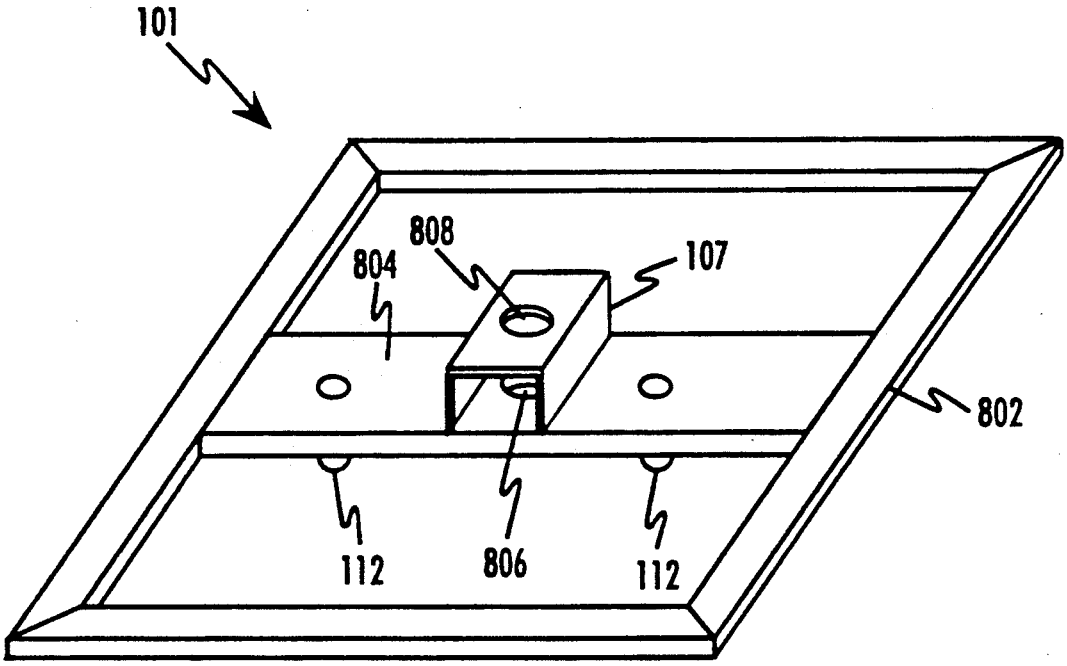
FIG. 8 is a frontal view of the device secured to the rigid support member.

FIG. 8 shows a perspective view of the base member 102. The base member 102 comprises five metal plate members. Four of the plates comprise the side members 802. These are attached to each other (e.g. by welding) so as to form an outline of a rectangle. Commonly, the rectangle would be a square. The corners of the rectangle could be rounded or tapered.

The fifth plate is the base attaching member 804. It could be attached to the side members 802 so as to extend between two of them, as shown in FIG. 9. Alternatively, it could be attached so as to form a 90 degree angle with the rear-most side member. The latter embodiment might be used, for example, in arenas with each row on a step higher than the one in front of it.

Two seat support members 104 are attached to and extend upward from opposing sides of the base member 102. These serve to support the seat member 105 to attach it to the base member 102. The tops of the seat support members 104 are attached to the seat member 105. If practical, the seat support members of the chair to which the detachable lockdown device is to be attached would be used. Otherwise, seat support members would be fabricated to fit the chair.

In the illustrated embodiment, the seat support members 104 form 90 degree angles with the base member 102 and are attached to both sides of the seat member 105. Note that the angles could be greater or less than 90 degrees. For example, the seat support members could extend at 45 degree angles and form a triangle with the base member 102. The apex of the triangle could then be secured to the bottom center of the seat member 105.

Two alignment members 112 extend from opposite sides of the base attaching member 804. These fit into openings in the rigid support member and serve to ensure that chairs attached to the detachable lockdown devices are properly aligned when installed.

Figure 7:
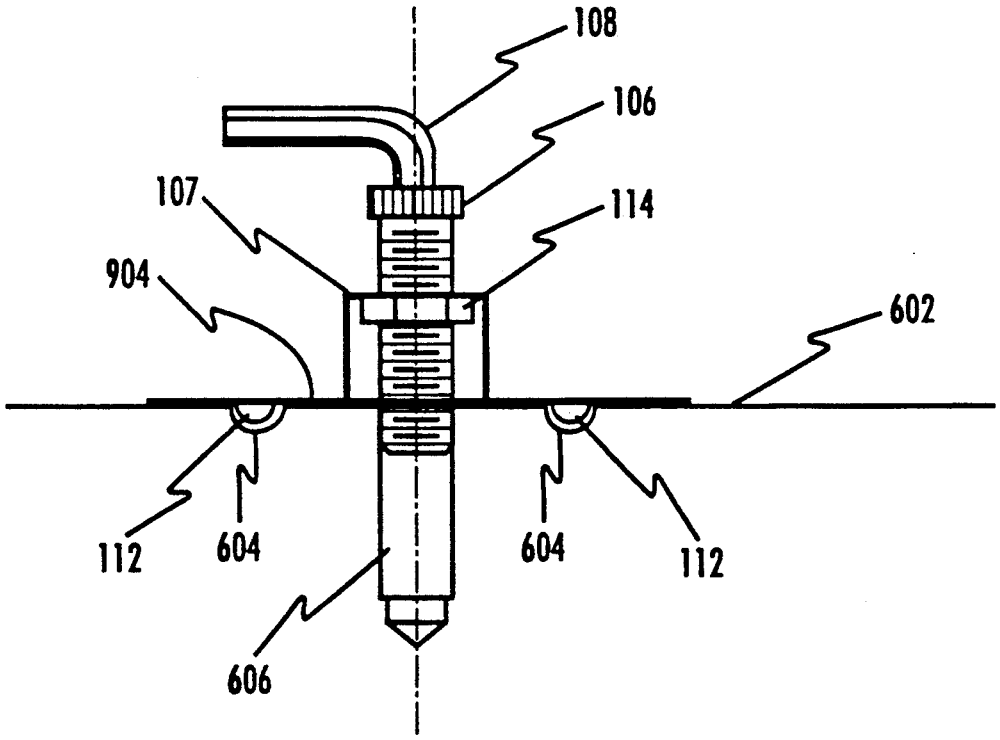
FIG. 7 is a frontal view of the base member ready to be secured to the rigid support structure by using the unlocking means to screw the removable securing means into the rigid support surface.

The base attaching member 804 has a base opening 806 halfway between the side strips to which it is connected. A flange member 107 in the shape of an upside-down "U" is attached to the base attaching member as shown in FIGS. 7 and 8. The flange member 107 has a flange opening 808 in its center as well. The flange member 107 is attached so that the two openings line up.

FIG. 7 shows how the removable securing means 106 fits through the openings of the base attaching member 802 and the flange member 107. The removable securing means 107 serves to secure the detachable lockdown device to the rigid support surface 116. A lock nut 114 is screwed onto the securing member between the two openings. Doing so serves to keep the removable securing means 106 with the base 101 so as to facilitate repeated installation and removal of the detachable lockdown devices.

Figure 2:
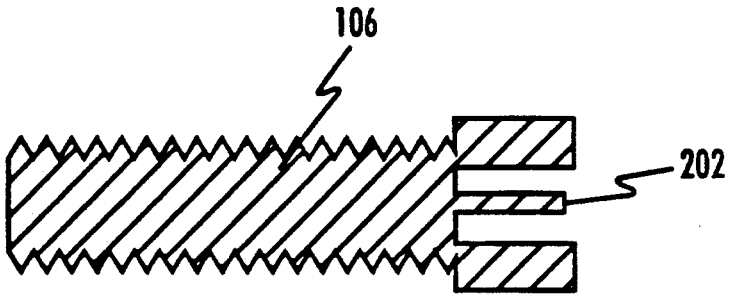
FIG. 2 is a cross-sectional view of the securing means taken along line 2—2 of FIG. 1.
Figure 3:
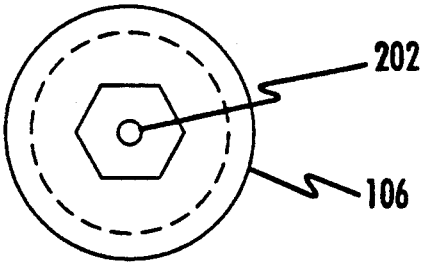
FIG. 3 is a top plan view of the securing means.

FIGS. 2 and 3 illustrate the details of a preferred removable securing means 106. The latter comprises a socket head cap screw. A fowling member 202 is permanently inserted into the center of a hex hole 204. The fowling member 202 prevents the removal of the removable securing means 106 (and therefore the detachable arena seat) with a standard allen wrench.

Figure 4:
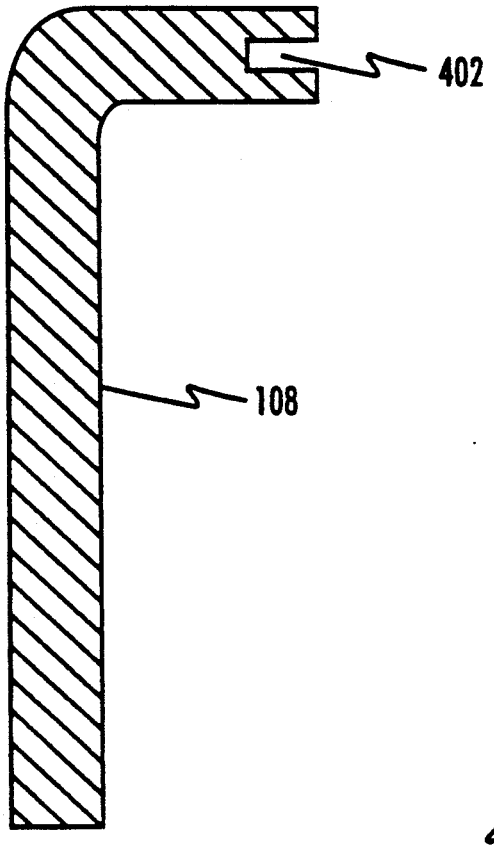
FIG. 4 is a cross-sectional view of the unlocking means taken along line 4—4 of FIG. 1.
Figure 5:
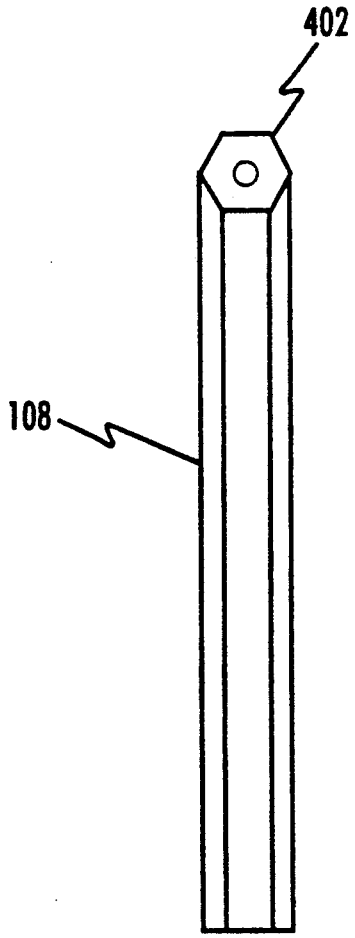
FIG. 5 is a frontal view of the unlocking means.

Consequently, unlocking means 108, illustrated in detail in FIGS. 4 and 5, comprises a hex wrench of appropriate size with an opening 402 into which the fowling member 202 fits.

Figure 6:
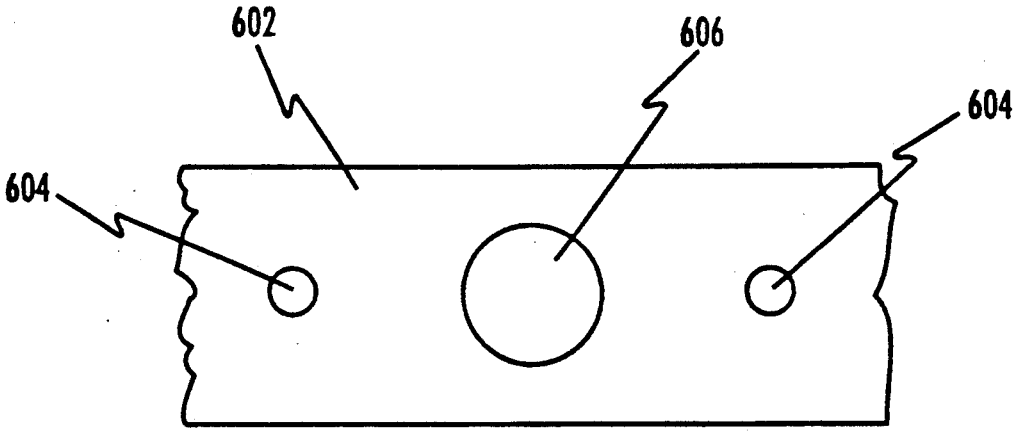
FIG. 6 is a top plan view of the rigid support means.

FIGS. 6 and 7 illustrate the installation of the detachable lockdown device. FIG. 6 shows an area of a rigid support member 602 upon which the detachable lockdown device is to be installed. In the rigid support member 602 are two alignment openings 604. The width of the openings should be such that the alignment members 112 will fit snugly into them. Centered between the alignment openings 604 is an attachment opening 606. The latter is threaded and is of appropriate dimensions so as to enable the removable securing means 106 to be screwed into it.

FIG. 7 shows the base attaching member 804 placed on the rigid support surface 116 so that the alignment members 112 fit into the alignment openings 604. The detachable lockdown device is attached to the rigid support surface 116 by using unlocking means 108 to screw securing means 106 into rigid support surface 116. FIG. 1 shows an installed detachable lockdown device with an arena chair.

Once installed, the detachable lockdown devices and arena chairs to which they are attached can be easily removed by arena officials to provide seating for the handicapped. The removal procedure parallels and is the reverse of the above described installation procedure. Securing means 106 is unscrewed with the unlocking means 108. The chair is then lifted from the rigid support surface 116. The chair can be stored during the event in arena storage areas such as those used for cleaning equipment, emergency equipment or concessionaires' supplies.

The exact method for accommodating the handicapped would depend on the seat layout of the particular arena. For example, seats in many arenas are closer to one another than the width of a wheelchair. Accommodating a handicapped patron would then generally require the removal of more than one chair. However, a wheelchair might be accommodated at an aisle seat location by removing only one chair. This would be possible as long as the aisles were sufficiently wide to prevent a slightly protruding wheelchair from interfering with egress or potentially violating fire codes.

Similarly, rows in many arenas are closer to one another than the width of a wheelchair. Again, multiple chairs would generally have to be removed to accommodate a handicapped patron at any but aisle seat locations.

The placement of the detachable lockdown devices in an arena could be designed so as to minimize cost and impact without sacrificing the advantages of the invention. For example, many arenas (such as theaters) have aisles which are ramped and thus fully accessible to the handicapped. Such an arena might be able to provide adequate handicapped seating by only installing chairs with detachable lockdown devices at the ends of rows.

Arenas with a stepped floors (such as a stadiums), on the other hand, might have blocks of chairs with detachable lockdown devices on the concourse level. Chairs in these blocks could be spaced so as to ease wheelchair maneuverability and minimize the number of chairs that would have to be removed to accommodate each handicapped patron. Also, strategic seating could reduce the number of chairs required to be removed. For example, a group of handicapped patrons could be seated from the aisle position inward.

While the preferred embodiments have been set forth, various modifications, alterations and changes may be made without departing from the spirit and scope of the present invention as defined in the appended claims.

We claim:

1. Apparatus for removably mounting a chair assembly to a rigid support surface, comprising a base member having a base member opening therethrough;

seat support members attached to and extending generally at angles greater than 0 degrees to the plane of said base member for mounting thereon a seat member;

a plurality of alignment members attached to and extending from said base member on substantially opposite sides of said opening, said alignment members being adapted to be received into openings in the rigid support surface;

removable securing means adapted to extend through said opening for securing said base member in engagement with the rigid support surface; and unlocking means engagable with said securing means for disengaging said securing means from enagagement with the rigid surface.

2. The apparatus of claim 1, wherein said base member opening is approximately in the center of said base member.

3. The apparatus of claim 1, wherein said removable securing means comprises a socket head cap screw and said unlocking means comprises a hex wrench.

4. The apparatus of claim 3, wherein said socket head cap screw has a fowling member for preventing a standard hex wrench from disengaging said socket head cap screw and said hex wrench has an opening in the center into which fowling member fits.

5. The apparatus of claim 1, further comprising means for tethering said removable securing means to said base member.

6. The apparatus of claim 5, wherein said tethering means comprises:

a flange with a flange opening in its center, wherein said flange is attached to said base member so that said flange opening is directly in line with said base member opening;

a securing means secured to said removable securing means between said flange opening and said base member opening.

7. The apparatus of claim 1 wherein said base member comprises a plurality of base side members and a base attaching member, wherein:

said base side members are attached to one another to form a rectangle;

said base attaching member is attached to one or more side members;

said alignment members extend from said base attaching member; and said base opening is in said base attaching member.

8. The apparatus of claim 7 wherein said base attaching means extends between and is attached to two said base side members so that said alignment members extend downward.

9. The apparatus of claim 7 wherein said base attaching means is attached to and forms an angle of approximately 90 degrees with rearmost said base side member.

* * * * *